United States Patent [19]

Vlk et al.

[11] Patent Number: 4,458,660

[45] Date of Patent: Jul. 10, 1984

[54] APPARATUS AND METHODS FOR PREPARING GRINDING WHEELS AND PERFORMING GRINDING OPERATIONS THEREWITH

[75] Inventors: Jaroslav Vlk; Johannes Woynowski, both of Uster, Switzerland

[73] Assignee: Gebr. Magerle AG, Switzerland

[21] Appl. No.: 329,253

[22] Filed: Dec. 10, 1981

[30] Foreign Application Priority Data

Dec. 11, 1980 [CH] Switzerland ..... 9161/80

[51] Int. Cl.[3] ..... B24B 53/14

[52] U.S. Cl. ..... 125/11 CD; 51/325

[58] Field of Search ..... 125/11 R, 11 CD, ; 51/165.87, 165.88, 325

[56] References Cited

U.S. PATENT DOCUMENTS

| | | | |
|---|---|---|---|
| 2,664,681 | 1/1954 | Clark | 125/11 CD |
| 3,584,616 | 6/1971 | Flohr | 125/11 CD |
| 3,971,358 | 7/1976 | Sawluk | 125/11 CD |
| 4,222,362 | 9/1980 | Kaiser | 125/11 CD |

FOREIGN PATENT DOCUMENTS

| | | | |
|---|---|---|---|
| 141486 | 11/1979 | Japan | 125/11 CD |

*Primary Examiner*—Harold D. Whitehead

*Attorney, Agent, or Firm*—Lerner, David, Littenberg, Krumholz & Mentlik

[57] ABSTRACT

Methods and apparatus for preparing a grinding wheel and performing a grinding operation are provided in accordance with the teachings of the instant invention wherein a single treatment cylinder is employed to profile a grinding wheel. Initially, a circumferential speed relation which is smaller than one (1) is employed between the grinding wheel and treatment cylinder to cause initial profiling to occur in a manner to avoid damage to the binding material. Thereafter, when a desired minimum area of contact is achieved, the circumferential speed relationship is increased to approximately one (1) to achieve a profiling having a desired grinding efficiency. A rough grinding operation may then be commenced. Upon the completion of the rough grinding operation, profiling of the grinding wheel may be again established using a circumferential speed relationship which is small to achieve a fine grinding profile. Thereafter, a fine grinding operation may be performed.

21 Claims, 5 Drawing Figures

APPARATUS AND METHODS FOR PREPARING GRINDING WHEELS AND PERFORMING GRINDING OPERATIONS THEREWITH

BACKGROUND OF THE INVENTION

The present invention relates to methods and apparatus for the preparation of grinding wheels with a treatment cylinder and methods and apparatus for performing grinding operations therewith. More particularly, the present invention is directed to techniques for selectively profiling a grinding wheel to enable various stages of a grinding operation to be performed at a single station where the grinding wheel may be reconfigured for differing functions between different stages in the operation.

The preparation of grinding wheels is generally performed by conventional methods which basically differ according to the circumferential speed relationship employed between the treatment cylinder and grinding wheel, the contact pressure relied upon, and the type of treatment cylinder used.

With the so-called crushing with a crushing cylinder, the circumferential speed $r_R \cdot w_R$ of the cylinder is made equal to the circumferential speed $r_S \cdot w_S$ of the grinding wheel. A substantial pressure, great enough to exceed the crushing strength of the binding material of the grinding wheel, is applied between the cylinder and the grinding wheel to cause single grains to be broken off of the grinding wheel. Due to this pressure, the grinding wheel is worked off to the negative form of the crushing cylinder. Therefore, the consistency of the surface of the grinding wheel, which corresponds to the graining of the grinding wheel, cannot be influenced. It is relatively rough and results in a correspondingly rough surface on the work piece in the grinding process.

In the second method, used as a supplement to the first, a diamond studded treatment cylinder or so-called diamond cylinder is used. The diamond cylinder is rotated with a speed which differs from that of the grinding wheel so that, contrary to the first method, the relative movement causes the diamonds to cut the grinding wheel grains. With this method, the resulting grinding wheel surface is considerably smoother than that achieved with the first method, with the relative smoothness of the surface being a function of the relative speed relationship selected. While each technique has advantages, the multiple steps involved, coupled with the varying procedures employed, render the resulting process costly and highly complex and do not allow convenient incorporation as an integral part of the grinding process.

Therefore, it is a principal object of the present invention to provide methods and apparatus for combining into a single technique, using a single treatment cylinder, the relative advantages of each of the two conventional methods of preparing grinding wheels and to adapt the same so that it may readily be incorporated within equipments for performing grinding operations. Various other objects of the present invention will become clear from the following detailed description of several exemplary embodiments thereof and the novel features will be particularly pointed out in conjunction with the claims appended hereto.

SUMMARY OF THE INVENTION

In accordance with the teachings of the present invention, methods and apparatus for preparing a grinding wheel are provided wherein a single treatment cylinder is employed to profile said grinding wheel. Initially, a circumferential speed relation which is smaller than one (1) is employed between the grinding wheel and treatment cylinder to cause initial profiling to occur in a manner to avoid damage to the binding material. Thereafter, when a desired minimum area of contact is achieved, the circumferential speed relationship is increased to approximately one (1) to achieve a profiling having a desired grinding efficiency. A rough grinding operation may then be commenced. Upon the completion of the rough grinding operation, profiling of the grinding wheel may be again established using a circumferential speed relationship which is small to achieve a fine grinding profile. Thereafter, a fine grinding operation may be performed.

BRIEF DESCRIPTION OF THE DRAWINGS

The invention will be more clearly understood by reference to the following detailed description of several exemplary embodiments thereof in conjunction with the accompanying drawings in which.

DETAILED DESCRIPTION

Figure 1:
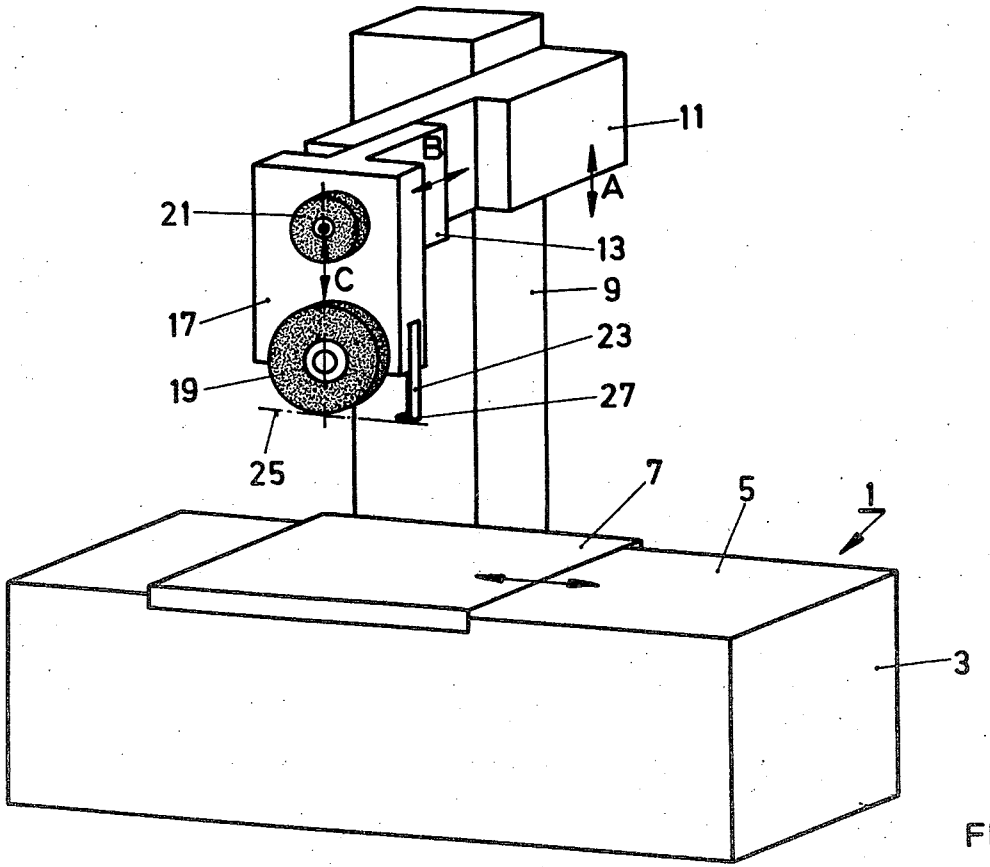
FIG. 1 illustrates basic structure of an exemplary grinding machine in which the present invention may be employed.

Referring now to FIG. 1, the basic structure of the exemplary grinding machine will be described. The grinding machine 1 consists of a stable support frame 3 having an actual grinding machine bed 5 disposed thereon. A transversely movable work table 7 is mounted on the upper surface of the grinding machine bed 5. Vertically protruding from support frame 3 is a frame 9 which is firmly connected on its long side with the basic cube-shaped support frame 3. A vertical support 11, which is movable vertically on frame 9 and horizontally with respect to the working table 7, is mounted on frame 9. The vertical support 11 protrudes parallel to table 7 and overhangs the latter as shown to provide a support for a horizontal support 13 which can be moved horizontally. The horizontal support 13 is configured to form a console 17 protruding down and parallel to frame 9 upon which is mounted a grinding wheel 19 and a treatment cylinder 21 for the grinding wheel 19. The grinding wheel 19 is, of course, movably mounted on an axis parallel to the table 7 and is vertically displaceable to the extent of its freedom on the console 17. The treatment cylinder 21 is movably mounted, in addition to its movable support, for displacement in a direction which is preferably parallel to the stand 9, so that it can be brought into contact with the grinding wheel 19.

A support element 23 is also mounted on the console 17 in a manner to protrude far enough below the console so that its end comes to rest at the height of the grinding wheel working area 25. At the end of support element 23 is mounted a water jet 27 which is directed toward the working area. The purpose of the grinding machine shown in FIG. 1 is to illustrate how the various component parts of the exemplary grinding machine are movable, relative to each other.

Figure 2:
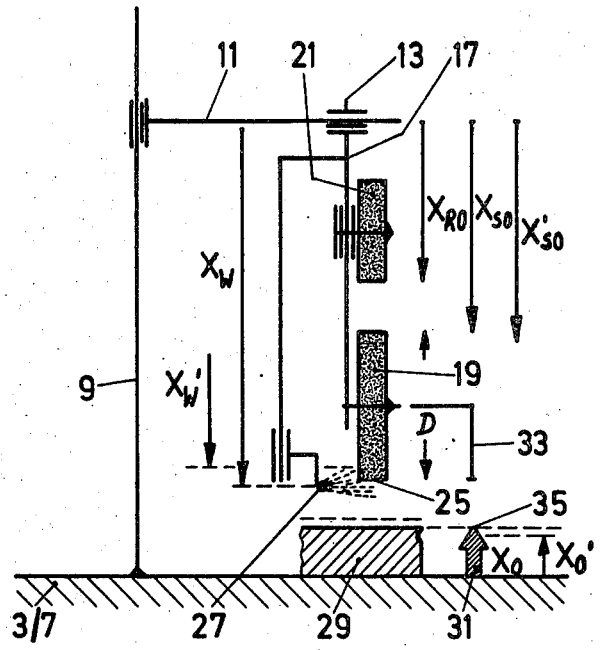
FIG. 2 is a schematic representation of the grinding machine shown in FIG. 1, wherein position coordinates have been illustrated for the structural parts which are displaceable relative to each other.

In FIG. 2, the arrangement according to FIG. 1 is illustrated schematically in detail with corresponding structural elements having the same reference numerals. With the aid of FIG. 2, the particular relative movements of the structural elements shall be explained together with the existing dependency with respect to one another. The vertical support 11 guides the grinding wheel 19 to a work piece 29 in the grinding operation. This corresponds to the movement according to arrow A of FIG. 1. The transverse adjustment of the grinding wheel with respect to the work piece 29 and the work table 7 is achieved by the horizontal support 13 employed to support the console 17. This corresponds to the movement indicated by arrow B in FIG. 1.

The treatment cylinder 21 on the console 17 is also transversely movable, for example parallel to the support 9 as indicated by arrow C in FIG. 1. This is used to refurbish a worn-down grinding wheel 19 in regard to its profile and also its surface condition. On a stationary structural group, if on stand 9 or on a support frame 3, a predetermined zero value 31 is allocated. It protrudes parallel to stand 9 and is operationally connected with a zero value gauge 33 which is vertically above it and moves at least in a vertical direction parallel to stand 9 with the grinding wheel 19. For this purpose, the zero value gauge 33 can be mounted on the console 17 or directly on the vertical support 11. The predetermined zero value 31 is provided with a stop 35 for the gauge 33 and is adjusted such that the gauge 33 then touches the stop 35 when the grinding wheel 19 has ground down the work piece 29 to a desired limiting value. For simplicity sake, as indicated in FIG. 2, the zero gauge 33 is illustrated as being displaceable down to the height of the grinding wheel operational area 25 so that the stop 35 may be adjusted exactly to the limiting value of the work piece 29 to be worked on. On the work piece the original height is shown marked with a line.

If the grinding wheel 19 is treated with the aid of a treatment cylinder 21, for example to a new profile, the grinding wheel diameter D will therefore be reduced. If the shortest distance from the vertical support 11 to the grinding wheel 19 before the operation was $X_{S0}$, then the distance after the operation is $X'_{S0}$ whereby $X_{S0}<X'_{S0}$. The difference between these two values corresponds to half the diameter removed from the grinding wheel 19. If the treated grinding wheel 19 is now used without changing the adjustment of the predetermined 0 value indicated at 31 and the zero value gauge 33, then the work piece 29 would be ground down only to a degree which is diminished by half the change in diameter. Thus, in order to always grind down the work piece to the same level, the nominal value of either the set value of 31 has to be reduced according to the reduction in the diameter of the grinding wheel 19, or the zero value gauge 33 must be adjusted to accommodate the new working area of the grinding wheel 19, i.e. adjusted for the decrease in the radius of the grinding wheel from the rotational axis.

The treatment cylinder 21 has to travel the distance between the cylinder periphery and wheel periphery before it first comes into contact with the grinding wheel 19. This is shown in FIG. 2 by the distance $(X_{S0}-X_{R0})$. With a change in the grinding wheel diameter, the distance $X_{S0}$ will increase to $X'_{S0}$ as mentioned above so that for the treatment cylinder to be brought into contact with the grinding wheel, information defining how far the grinding wheel 19 was reduced during the last treatment process must be stored.

It should be understood that while mechanical elements have been described, the zero value gauge 33, the predetermined value 31, and the stop 35 can be implemented by electronic means, opto-electronic means, or other well-known and corresponding evaluation means. Here however, the prime considerations are the important geometrical values and relationships and their respective changes during operation.

In order to cool the working piece, a water jet 27, as already mentioned in connection with FIG. 1, is directed to the working area 25 of the grinding wheel 19. Since the cooling jet 27 must always be directed at the work area 25, the jet 27 must also be adjusted in height to a value corresponding to the distance between vertical support 11 and the grinding wheel periphery by a value corresponding to the material the treatment cylinder 21 has removed from the grinding wheel 19.

Figure 3:
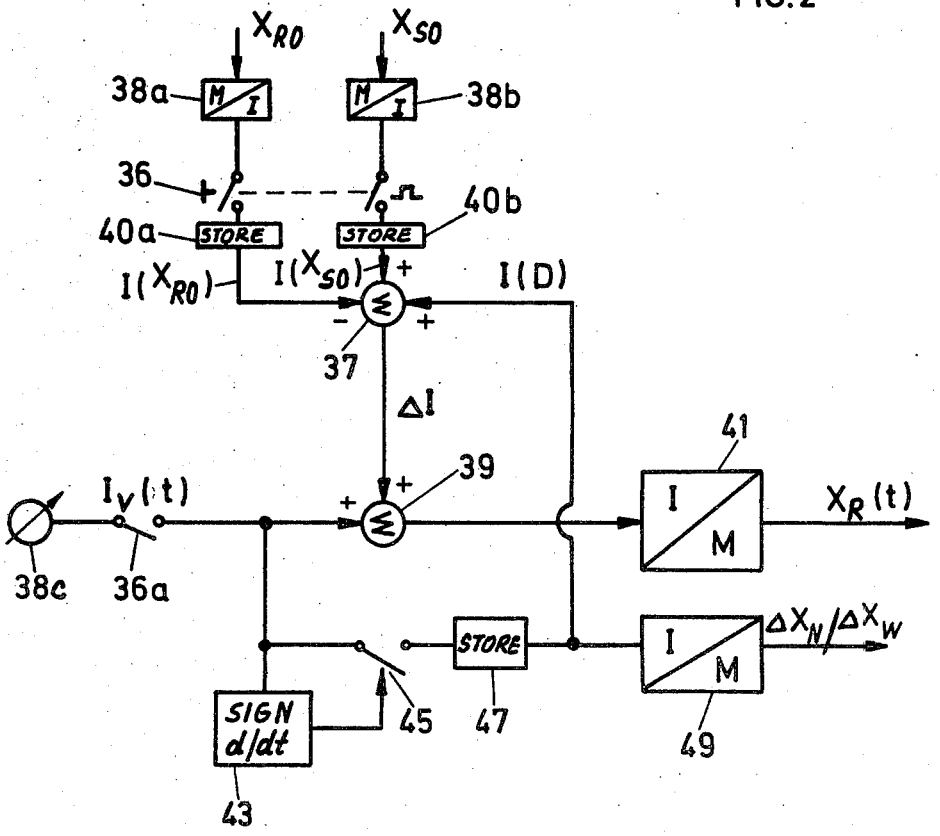
FIG. 3 is a basic signal-flow diagram for the compensation measurements regarding the position coordinates of the grinding machine shown in FIG. 2.

In FIG. 3 there is shown a signal-flow diagram employed to show an exemplary technique for compensating for the material removed from the grinding wheel. In FIG. 3 the following reference characters connote the following:

$I(X_{R0})$: Information regarding the rest position of the treatment cylinder 21, $I(X_{S0})$: Information regarding the initial distance of the grinding wheel working surface for example from the vertical support (corresponding to the initial grinding wheel diameter), $I_V(t)$: Supplied information regarding the thrust of the treatment cylinder to a grinding wheel contact, $X_R(t)$: The distance traveled by the treatment cylinder 21, $\Delta X_N$: Compensation distance of the zero point adjustment;

$\Delta X_W$: Compensation distance of the water jet,

I(D): Diameter decrease of the grinding wheel 19 caused by sequential treatment process.

The information I variously indicated in FIG. 3 is preferably in the form of electrical signals. For this purpose, a sensor $38_a$ is provided to sense $X_{R0}$, a sensor $38_b$ is provided to sense $X_{SO}$, and an input device $38_c$ is provided to indicate the cylinder thrust. The sensors $38_a$, $38_b$ may take the form of conventional opto-electrical converters, while the input device $38_c$ may take the form of a conventional ramp generator having an analog or digital input for the ramp edge. In a first superposition unit or summing point device 37, the information I ($D_{RO}$ and $X_{SO}$) are compared with each other after recall from the storage devices $40_a$, $40_b$. This occurs at the actuation of an initial treatment process as started, for example, by the actuation of the button 36.

The differential result $\Delta I$ is applied to a second superposition unit 39. The unit 39 sums the differential information $\Delta I$ with the information $I_V(t)$, representing the thrust of the treatment cylinder, which is applied thereto when the switch $36_a$ is closed. This result is applied to a conventional converter 41 which acts to change this information into a mechanical movement $X_R(t)$ for the treatment cylinder 21. If the information I is in the form of electrical signals, the converter 41 will take the form of a conventional electro-mechanical converter, for example, an electric motor. In order to register the resulting decrease of the diameter of the grinding wheel 19 caused by the treatment process, the information $I_V(t)$ is always checked in a differentiator unit 43 as to the extreme position. By detecting this position upon reaching a condition of zero pressure between cylinder 21 and wheel 19, which occurs shortly before the release of their contact and causing unit 43 to close switch 45, the momentary value of the information $I_V(t)$ is applied to storage unit 47. Since this momentary information corresponds to the decrease in the radius of the grinding wheel 19, it must be added to the original predetermined value $I(X_{SO})$ in the next treatment process. To this end, the output of the storage unit 47 is applied to the super-position unit 37. The contents of the storage unit 47 also correspond to information representing the necessary correction displacement of the water jet and the zero value unit. The contents of the storage unit 47 is therefore also applied as shown to the converter 49 which initiates the displacement and compensation of the water jet and zero value unit.

Figure 4:
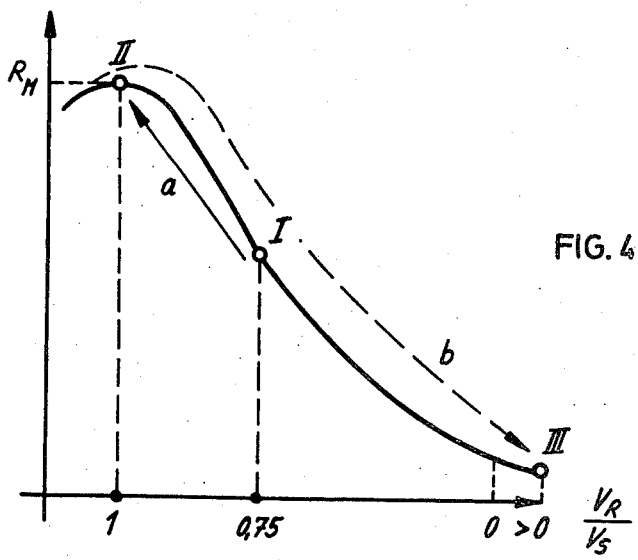
FIG. 4 illustrates a plot of the qualitative flow of grinding wheel roughness as a function of the circumferential speed relationship of the treatment cylinder and the grinding wheel during the treatment process.

In FIG. 4 is shown a plot of the relationship of the circumferential speed $V_R$ of a diamond cylinder 21 and the circumferential speed $V_S$ of the grinding wheel 19 plotted as a ratio along the abscissa and the qualitative resulting grinding wheel roughness plotted along the ordinate. In FIG. 4, it will be seen that maximum grinding wheel roughness and therefore cutting capability of the grinding wheel result at a speed ratio $V_R/V_S$ corresponding to 1. However, profiling may not be initiated at such a ratio because the grinding wheel would be broken out only at the contact points with the diamonds and the binding material of the diamond cylinder would be damaged as soon as it comes into contact with the grinding wheel. This would result in a falling out of the diamonds on the cylinder and hence the destruction of the cylinder.

When a relationship which is smaller than 1 is employed, for example 0.75, practically the entire grinding wheel surface is shaped by the diamonds due to the relative speed of the cylinder and grinding wheel circumference. This is not the case with a relationship of 1 as cutting does not take place. Therefore, with this smaller speed ratio, the diamond cylinder will not be damaged and this speed relationship also allows a good profiling even though the grinding wheel will not display an optimal cutting capability. If the circumferential speed relationship approaches zero or even becomes negative, as will be seen in FIG. 4, the roughness decreases and therefore the cutting capability of the grinding wheel decreases rapidly.

For rough grinding operations, of course, it is desired that the grinding wheel be shaped to its optimum cutting capability in order to maintain maximum efficiency and shorter grinding times. To this end, an optimal cutting capability corresponding to $R_M$ at the circumferential speed relationship 1 must be achieved with the diamond cylinder. This is achieved in accordance with the teachings of the present invention by a first treatment process in which the grinding wheel is profiled with a circumferential speed relationship of nearly 0.75, and subsequently with a relationship of nearly 1 to achieve an optimal cutting capability. Since the profiling can be accomplished using a speed relationship of approximately 0.75, where the grinding wheel and diamond cylinder do not have the same circumferential speed, without damaging the diamond cylinder, the cutting capability of the already finished grinding profile can be subsequently modified using a speed relationship of nearly 1 with a contact area which is smaller than the size of the diamonds on the binding material. The binding material thus is never in contact with the grinding wheel, and hence, is not damaged so that falling-out of the diamonds due to damaging of the grinding material will not occur. The displacement of the circumferential speed relationship from point I in FIG. 4 where the speed relationship is 0.75, to point II where the speed relationship is 1, is indicated by the arrow A in FIG. 4.

A profiled grinding wheel may therefore be produced using only a single cylinder which has an optimal cutting capability without damaging the cylinder. Accordingly, the surface of the work piece which is ground by a grinding wheel configured for maximum cutting will stay relatively rough. If it is desired that the work piece subsequently be given an optimally smooth surface, another operational step may be added for this purpose. In this manner, after a first grinding process is completed in which the work piece is profiled according to point II with the grinding wheel, the grinding wheel is reworked with a circumferential speed relationship of nearly 0 or even negative, according to point III, and the work piece can be reworked with the extremely fine grinding wheel. The dashed line b in FIG. 4 shows the addition of this operational step at the completion of the first grinding process.

When the drive mechanism (not shown) for the grinding wheel 19 and the driving mechanism (not shown) for the treatment cylinder 21 can be adjusted continuously in regards to speed or even the direction of rotation, the grinding machine according to FIG. 1 may reflect an automatic design made to reflect the steps of method described in connection with points I and II (FIG. 4) and/or fine profiling as discussed in connection with point III. Exemplary apparatus for accomplishing the described method of profiling a grinding wheel in a grinding machine may therefore be achieved by employing the techniques described in connection with FIG. A. Thus, through the use of these techniques, a diamond cylinder, as present in a grinding machine, may be employed to maintain a grinding wheel in optimum condition for cutting, and with an additional process, the same grinding wheel 19 can be converted to a fine grinding wheel.

From the description above, it will be clear that for exact adjustment of the circumferential speed relationship of the diamond cylinder, or for that matter, of a crushing cylinder and a grinding wheel, the necessary information must be calculated as a function of the resulting reduction of the diameter of the grinding wheel, the rotation of the grinding wheel and/or treatment cylinder in the treatment process. However, this information is basically available as described in FIG. 2 by employing devices such as potentiometers, optoelectrical converters, etc., to detect the resulting reductions.

Figure 5:
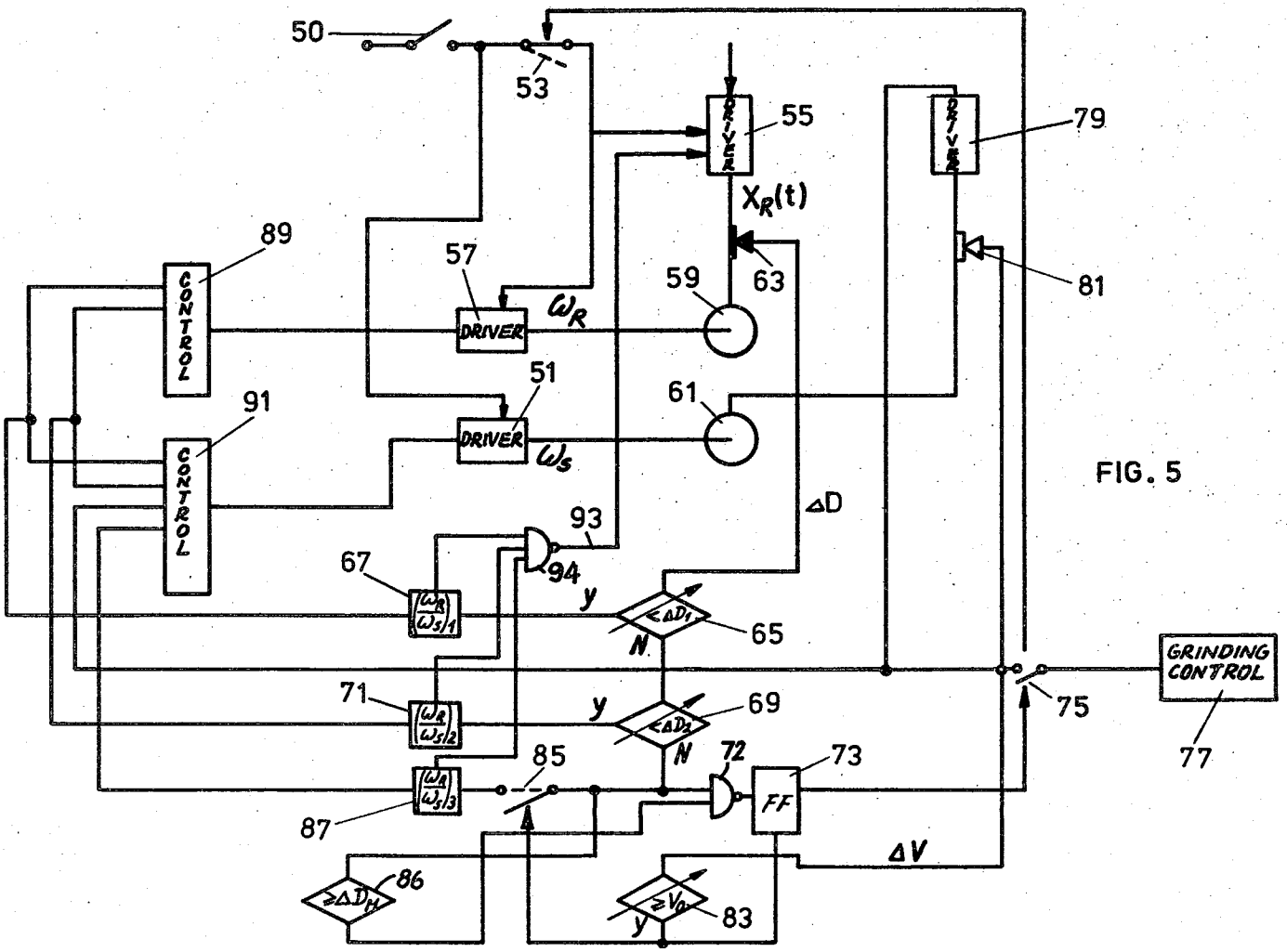
FIG. 5 is a signal-flow diagram of an exemplary grinding machine control system and use thereof for the automatic treatment of the grinding wheel in accordance with a preferred embodiment of the present invention.

In FIG. 5, there is shown a functional block diagram for an exemplary embodiment of a control system for extending the instant invention to a grinding machine of the type illustrated in FIG. 1. Referring now to FIG. 5, it will be seen that by closing a starting switch 50, the grinding wheel drive mechanism 51 and, with switch 53 closed, the cylinder contact drive mechanism 55 and the cylinder drive mechanism 57 are started. The treatment cylinder 59 is brought into contact with the grinding wheel 61 by being displaced by the cylinder drive mechanism 57 through a displacement distance $X_R(t)$, as available from the circuitry shown in FIG. 3.

As profiling of the grinding wheel 61 is occurring, that portion of $X_R(t)$ responding to the diameter of the grinding wheel 61 that is reduced in radius $\Delta D$, is sensed by detector 63. The value $\Delta D$ sensed by the detector 63 is checked in a first comparison unit 65 to determine if it is larger or smaller than a predetermined limiting value $D_1$. So long as $\Delta D$ as sensed is smaller than the value $D_1$, the cylinder drive mechanism 57 and the grinding wheel drive mechanism 51 are controlled by a primary relationship control unit 67. The control unit 67 supplies control signals to the motor drive controllers 89 and 91 to cause the cylinder 59 and the grinding wheel 61 to be driven by drivers 57 and 51 so that a circumferential speed relationship corresponding to point I of FIG. 4 results. Thus, units 65 and 67 preferably adjust for a $\Delta D$ corresponding to a removal of material sufficient to reduce the area of contact between the cylinder and the grinding wheel to a sufficiently small area and retain the relative speed ratio in the area of point I until this is achieved.

When the reduced diameter $\Delta D$ is greater than the prescribed first limiting value $\Delta D_1$, the displacement $\Delta D$, as measured by detector 63, is next compared, as indicated by conductor N in a second comparison unit 69, with a second predetermined limiting value $\Delta D_2$. As long as $\Delta D$ is smaller than this limiting value $\Delta D_2$, the two drive units 57 and 51 are controlled by a second relationship control unit 71 which supplies a signal to motor drive controllers 89 and 91 to cause the cylinder 59 and the grinding wheel 61 to be driven according to the circumferential speed relationship of point II in FIG. 4 so that a maximum roughness for cutting is achieved. The limiting value $\Delta D_1$ thus corresponds to a predetermined profiled depth at which the speed relationships of the cylinder 59 and the grinding wheel 61 may be changed from point I to point II in FIG. 4, while the limiting value $\Delta D_2$ is indicative of a depth at which an optimum cutting profile has been achieved by the dimensions of the grinding wheel.

When the reduced diameter $\Delta D$ reaches the limiting value $\Delta D_2$, the grinding wheel is ready for a grinding operation. Accordingly, as indicated, a switching unit 73 is actuated through a NAND gate 72 to actuate switch 75 and connect control unit 77 to the motor drive controller 91 for enabling driver 51 to cause the grinding wheel to assume grinding speed. The actuation of switch 75 also opens the switch 53 so that the cylinder drive mechanism 57 and the cylinder contact drive mechanism 55 become inoperative. The result is a withdrawal of the treatment cylinder 59 from the grinding wheel 61. The now automatically actuated grinding process which is controlled by the unit 77 causes a thrust movement of the vertical supports of the machine by means of its drive group 79 to bring the grinding wheel 61 into a grinding relationship with the work piece.

The thrust movement is detected by a detector 81, which may take the form of a potentiometer or the like. The output of detector 81 is applied to a comparison unit 83 which compares the vertical thrust to a limiting value $V_0$ corresponding to a completion of the rough grinding operation. If the vertical support thrust reaches the predetermined limiting value $V_0$, the profile grinding operation is terminated and the switching unit 73 is switched over to its initial position. This action occurs as an affirmative output from comparison unit 83 resets flip-flop 73 restoring switch 75 to its upward position. This action of comparison unit 83 will also cause switch 85 to be closed to its dashed position. The control of the grinding machine drive mechanism by the unit 77 is thus interrupted and switch 53 is closed actuating the drive mechanism 55 for the cylinder to cause the same to be brought into contact with the grinding wheel 61. The cylinder drive mechanism 57 is also started again and driver 79 is de-energized. Basically, the grinding wheel drive mechanism is thus always being driven.

Since the reduced diameter detected by the detector 63 is now larger than $\Delta D_2$ and switch 85 has been closed by the action of comparitor 83 when the limiting value $V_0$ for the vertical thrust was reached during the initial grinding operation, the circumferential speed relationship of cylinder 59 and grinding wheel 61 is controlled by the relationship control unit 87 and the comparitor 86. The speed control exercised by the control unit 87 is such that a speed relationship corresponding to the relationship of point III in FIG. 4 is maintained until a displacement value of $\Delta D_M$ is sensed. When the reduced diameter $\Delta D$ reaches the limiting displacement value $\Delta D_M$, the switching unit 73 is again actuated through NAND gate 72 whereby the last treatment step on the grinding wheel is finished and the finishing process is started. The value selected for $\Delta D_M$ corresponds to a diameter reduction on the grinding wheel 61 required to assure a suitable fine profile. Upon reaching of the final finished mass for the work piece, the grinding operation is interrupted by the opening of switch 50.

The two motor control units 89 and 91 supply appropriate control signals from the relationship control units 67 and 71 or 87, alternatively, to the drive mechanisms 57 and 51 or supply, during the grinding process, the control signals from the control unit 77 to the drive mechanism 51. The cylinder contact mechanism 55, as indicated by the return line 93 from NAND gate 94, is also influenced by the control units 67, 71 and 87, each according to the circumferential speed relationship which is maintained constant. According to this relationship, the cylinder thrust can take place at a slower or faster rate as described in conjunction with FIG. 4.

The control functions described in connection with FIG. 5 may be accomplished by typical functional blocks using analog-digital or hybrid techniques. Especially suited for these functions is a computer if further supervisory adjusting and control functions are to be automated. Additionally, individual or grouped control functions may be implemented using microprocessor techniques.

The described invention allows, when coupled with the control functions shown in FIG. 4, for example, continuous automatic adjustable speed control of the treatment cylinder and/or grinding wheel. Under these conditions, it is preferred that a diamond cylinder be employed to profile the grinding wheel and thereafter to suitably configure it for optimum cutting. Subsequently, the same diamond cylinder may be employed in an additional treatment process to prepare the grinding wheel for the finishing grind.

While this invention has been described in connection with a preferred exemplary embodiment thereof, it will be understood that many modifications and alterations thereof will be readily apparent to those of ordinary skill in the art; and that this application is intended to cover any adaptations or variations thereof. Therefore, it is manifestly intended that this invention be only limited by the claims and the equivalents thereof.

What is claimed is:

1. A method for the preparation of a grinding wheel with a treatment cylinder having hard grains embedded in a binder material comprising the steps of:

establishing an initial circumferential speed relationship between said treatment cylinder and said grinding wheel which is less than one and profiling said grinding wheel with said treatment cylinder until a selected area of contact therebetween is obtained; and changing said circumferential speed relationship to a value of at least nearly one and continuing preparation of said grinding wheel by said treatment cylinder until a desired cutting characteristic is achieved by said grinding wheel.

2. The method of preparation according to claim 1 additionally comprising the step of employing a diamond lined cylinder as said treatment cylinder.

3. The method of preparation according to claim 1 additionally comprising the step of choosing a feed of said treatment cylinder and said grinding wheel towards each other at a changed circumferential speed relationship sufficiently small to enable said grains on said treatment cylinder to contact said grinding wheel with said binder material not contacting said grinding wheel.

4. The method of preparation according to claim 1 wherein said initial circumferential speed relationship is selected at a value approximating 0.75.

5. The method of preparation according to claim 1 additionally comprising the steps of:

employing said grinding wheel having a desired cutting characteristic in an initial stage of a grinding operation;

providing a circumferential speed relationship between said treatment cylinder and said grinding wheel which is smaller than one; and treating said grinding wheel with said treatment cylinder until a desired finish is obtained on said grinding wheel.

6. Grinding apparatus including a grinding wheel and a treatment cylinder having hard grains embedded in a binder material for preparing said grinding wheel comprising:

first means for driving said grinding wheel and imparting angular velocity thereto;

second means for driving said treatment cylinder and imparting angular velocity thereto;

means for selectively displacing said treatment cylinder into a circumferentially contacting relationship with said grinding wheel to enable said preparing thereof and for maintaining said contacting relationship during said preparing of said grinding wheel;

means for measuring the magnitude of the displacement of said treatment wheel into a circumferentially contacting relationship with said grinding wheel during the preparation thereof; and control means responsive to said means for measuring for controlling said first and second means for driving to establish selected circumferential speed relationships between said treatment cylinder and said grinding wheel during the preparation thereof, said control means establishing at least a first circumferential speed relationship between said treatment cylinder and said grinding wheel during intervals when said magnitude of displacement is less than a predetermined value, wherein said first circumferential speed relationship has a value which is less than one and a second circumferential speed relationship between said treatment cylinder and said grinding wheel when said magnitude of displacement exceeds said predetermined value, wherein said second circumferential speed relationship has a value of at least nearly one.

7. The grinding apparatus according to claim 6 wherein said treatment cylinder takes the form of a diamond lined cylinder and said predetermined value represents a displacement distance representing sufficient treatment of said grinding wheel to insure that said treatment cylinder and said grinding wheel are in a circumferentially contacting relationship over an area which is sufficiently small to enable diamond grains on said treatment cylinder to contact said grinding wheel while binding material for retaining said diamonds on said treatment cylinder is not placed in contact with said grinding wheel being treated.

8. The grinding apparatus according to claim 6 additionally comprising:

means for placing said grinding wheel in a grinding relationship with a work piece; and grinding control means responsive to said means for measuring, upon a measurement of a selected magnitude of displacement, greater than said predetermined value, for disabling said means for displacing, enabling said means for placing and causing said first means for driving to impart a grinding angular velocity to said grinding wheel.

9. The grinding apparatus according to claim 8 additionally comprising:

sensing means for measuring intervals of displacement imparted to said grinding wheel by said means for placing said grinding wheel in a grinding relationship with a work piece; and means responsive to an interval of displacement measured by said sensing means indicating a stage of a grinding operation has been completed for disabling said means for placing, enabling said means for displacing and causing said first and second means for driving to establish a third circumferential speed relationship between said treatment cylinder and said grinding wheel.

10. The grinding apparatus according to claim 9 wherein said third circumferential speed relationship between said treatment cylinder and said grinding wheel has a value suited to achieve fine preparation of said grinding wheel.

11. The grinding apparatus according to claim 9 wherein said third circumferential speed relationship has a value which is substantially smaller than value selected for said first and second circumferential speed relationships.

12. The grinding apparatus according to claim 9 wherein said third circumferential speed relationship has a value which is very small.

13. The grinding apparatus according to claim 9 additionally comprising fine grind control means responsive to a determined magnitude of displacement measured by said means for measuring for disabling said means for displacing, enabling said means for placing and causing said first means for driving to impart a grinding angular velocity to said grinding wheel.

14. The grinding apparatus according to claim 13 wherein said determined magnitude of displacement is indicative that preparation of said grinding wheel to a fine grinding configuration has been completed.

15. A method for the preparation of a grinding wheel with a treatment cylinder having hard grains embedded in a binder material and the use thereof comprising the steps of:

establishing an initial circumferential speed relationship between said treatment cylinder and said grinding wheel which is less than one and profiling said grinding wheel with said treatment cylinder until a selected area of contact therebetween is obtained;

changing said circumferential speed relationship to a value of at least nearly one and continuing preparation of said grinding wheel by said treatment cylinder until a desired cutting characteristic is achieved by said grinding wheel;

employing said grinding wheel having a desired cutting characteristic in an initial stage of a grinding operation;

providing a circumferential speed relationship between said treatment cylinder and said grinding wheel which is smaller than one; and treating said grinding wheel with said treatment cylinder until a desired finish is obtained on said grinding wheel.

16. The method of preparation according to claim 15 additionally comprising the step of utilizing said grinding wheel with said desired finish in a latter stage of a grinding operation.

17. The method of preparation according to claim 15 additionally comprising the step of employing a diamond lined cylinder as said treatment cylinder.

18. The method of preparation according to claim 15 additionally comprising the step of choosing a feed of said treatment cylinder and said grinding wheel towards each other at changed circumferential speed relationship of at least nearly one sufficiently small to enable said grains on said treatment cylinder to contact said grinding wheel with said binder material not contacting said grinding wheel.

19. The method of preparation according to claim 15 wherein the presence of said selected area of contact is determined by a sensing of displacement of said treatment cylinder.

20. Grinding apparatus including a grinding wheel and a treatment cylinder having hard grains embedded in a binder material for preparing said grinding wheel comprising:

means for establishing an initial circumferential speed relationship between said treatment cylinder and said grinding wheel which is less than one and profiling said grinding wheel with said treatment cylinder until a selected area of contact therebetween is obtained; and means for changing said circumferential speed relationship to a value of at least nearly one and continuing preparation of said grinding wheel by said treatment cylinder until a desired cutting characteristic is achieved by said grinding wheel.

21. The grinding apparatus according to claim 20 wherein said initial circumferential speed relationship is selected at a value approximately 0.75.

* * * * *